US006301712B1

(12) United States Patent
Miyata

(10) Patent No.: US 6,301,712 B1
(45) Date of Patent: Oct. 16, 2001

(54) COLLAR AND SLEEVE SHAPING METHOD AND APPARATUS

(76) Inventor: Yukio Miyata, 738-4, Odera, Miharacho, Minamikawachigun, Osaka (JP)

( * ) Notice: Subject to any disclaimer, the term of this patent is extended or adjusted under 35 U.S.C. 154(b) by 0 days.

(21) Appl. No.: 09/498,841

(22) Filed: Feb. 7, 2000

(51) Int. Cl.[7] ..... D06C 15/00
(52) U.S. Cl. ..... 2/52.1; 2/52; 2/57; 2/61
(58) Field of Search ..... 223/52.1, 61, 57, 223/52; 38/21, 12

(56) References Cited

U.S. PATENT DOCUMENTS 1,766,187 * 6/1930 Pauly ..... 38/12
2,147,596 * 2/1939 Long ..... 38/12
2,365,448 * 12/1944 Bicknell ..... 38/21
3,685,179 * 8/1972 Michaels ..... 38/21
3,835,559 * 9/1974 Kotter ..... 38/21

* cited by examiner

*Primary Examiner*—Bibhu Mohanty
(74) *Attorney, Agent, or Firm*—Moonray Kojima

(57) ABSTRACT

The present invention relates to a method and apparatus for hot pressing and finishing the collar and sleeves of a washed shirt by lower irons and an upper ion, and more particularly to a method and apparatus for heating the collar and sleeves before hot pressing stage, loosening the adhesive padding cloth being shrunk by washing, pulling the collar and sleeves in this state in the cloth stretching direction by a stretching mechanism provided between the lower irons and upper iron, and hot pressing after removing shrinkage and crease from the collar and sleeves.

6 Claims, 12 Drawing Sheets

COLLAR AND SLEEVE SHAPING METHOD AND APPARATUS

BACKGROUND OF THE INVENTION

1. Technical Field of the Invention

The present invention relates to a technique for finishing the collar and sleeves of a shirt after washing.

2. Prior Art

The collar and sleeves of a shirt are composed of face and back cloths, and a thin adhesive padding cloth inserted between them, which are pressed by a high pressure press. The adhesive padding cloth shrinks when washed. It usually shrinks by about 10 to 15%. As a result, the surface is creased and the size is reduced. The existing apparatuses are designed to press instantly at a high pressure because the working efficiency is most important, and are not designed to correct the shrunk state. Being finished in the shrunk state, the size is reduced and creases are formed.

SUMMARY OF THE INVENTION

It is hence a primary object of the invention to straighten the shrinkage of padding cloth easily even when finishing by machine.

That is, it is intended to present a collar and sleeve shaping method comprising a heating step for heating the cloth, and a stretching step for stretching the cloth heated at the heating step, before the press stage.

It is also intended to present a collar and sleeve shaping apparatus comprising a stretching mechanism for catching the end of a cloth before the press stage and pulling in the cloth stretching direction, between an upper iron and a lower iron.

It is other object of the invention to stretch uniformly and finish homogeneously in an easy operation, by stretching at the stretching step by means of a stretching mechanism installed between an upper iron and a lower iron, in this collar and sleeve shaping method.

That is, according to the above constitution, before the press stage, the cloth put on the lower iron is pulled and stretched at the stretching step and by the action of the stretching mechanism. Accordingly, even in machine finishing where high working efficiency is demanded, the cloth can be pressed in a stretched state, and a favorable finishing state similar to a brand-new product free from shrinkage or crease may be obtained.

Other objects of the invention will be more clearly understood from the following description of the embodiments.

EMBODIMENTS

An embodiment of the invention is described below while referring to the accompanying drawings.

Figure 1:
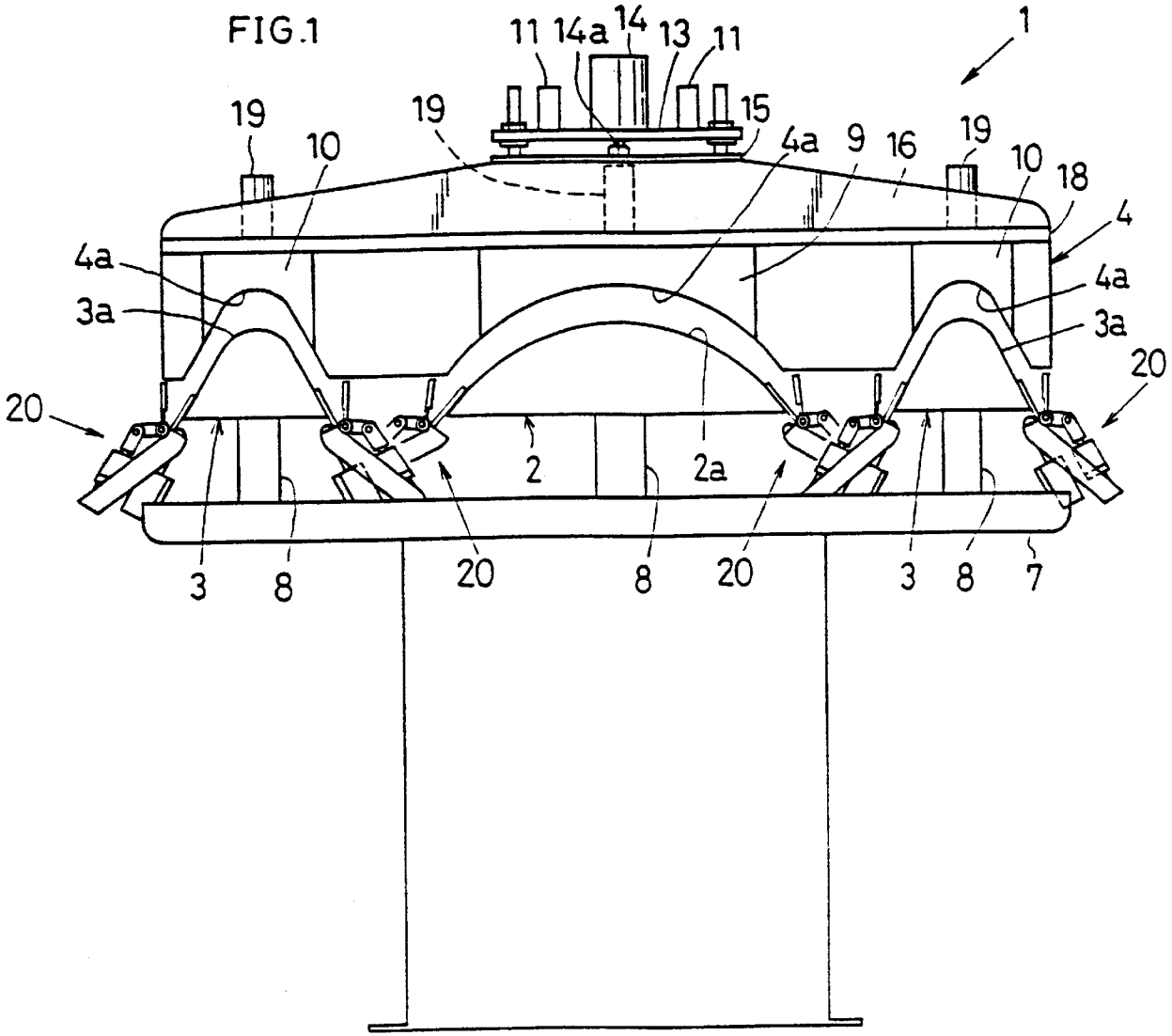
FIG. 1 is a front view of a collar and sleeve shaping apparatus of the invention.

A collar and sleeve shaping apparatus 1 (hereinafter called apparatus) is a hot pressing apparatus for a collar 5 and sleeves 6 by lowering an upper iron 4 onto lower irons 2, 3, 3. FIG. 1 shows a confronting state of the lower irons 2, 3, 3 and the upper iron 4.

In order to press the collar 5 and sleeves 6 simultaneously, there is one lower iron 2 for the collar having a smoothly curved upper surface, and two lower irons 3, 3 for the sleeves of a nearly triangular shape in a front view, and three press faces 4*a*, . . . in the shapes corresponding to the press faces 2*a*, 3*a* of these lower irons 2, 3, 3 are formed on the upper iron 4.

The lower irons 2, 3, 3 are of known structure, and they are supported at a specified height by means of support columns 8 on the upper surface of a base 7.

The upper iron 4 incorporates known heating means (not shown), and hot plates (not shown) are mounted on the press faces 4*a*, . . . The press faces 4*a*, . . . are divided in three sections in the lateral direction, and only upper iron intermediate members 9, 10, 10 positioned in the middle are allowed to move vertically.

Figure 2:
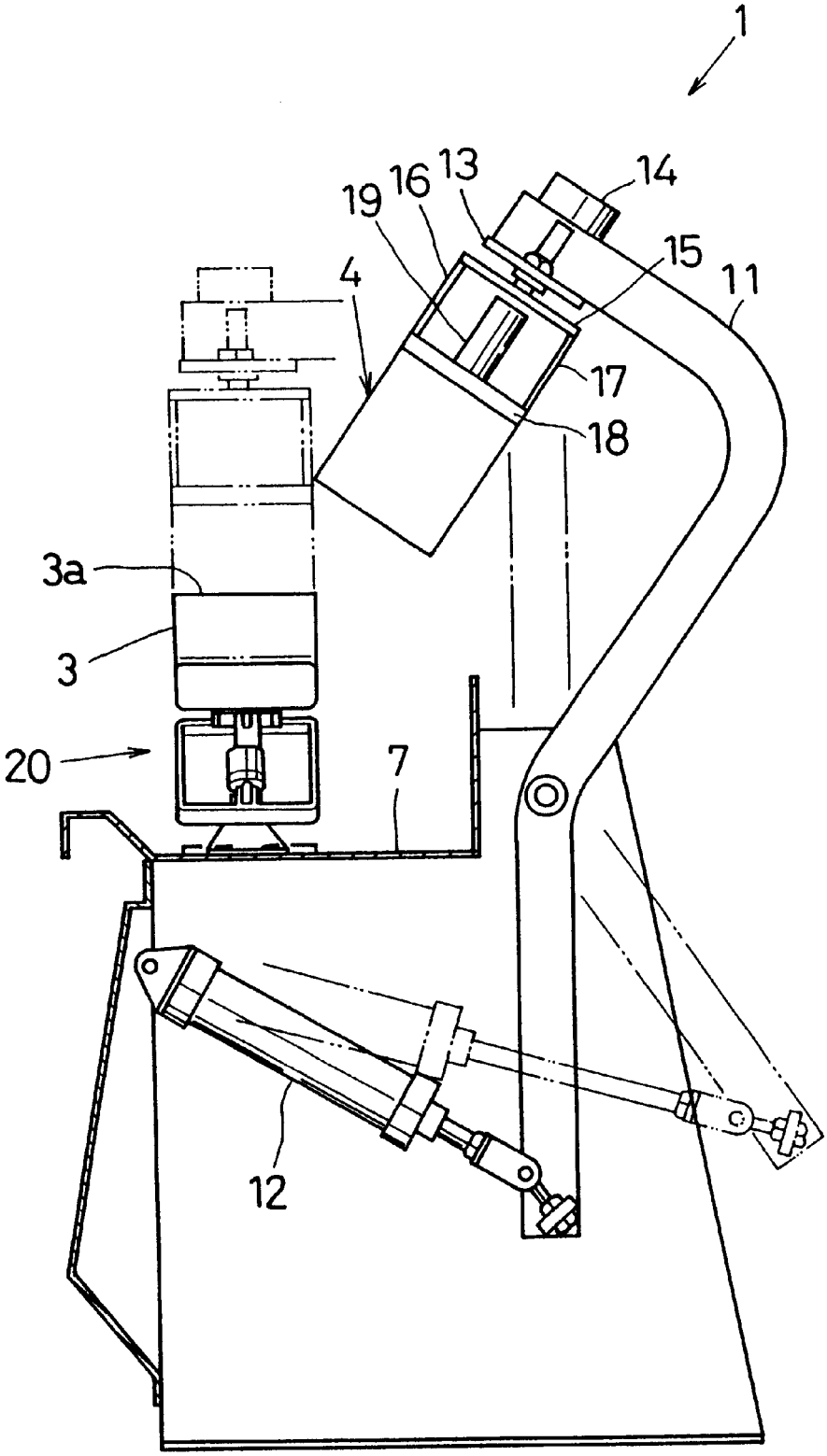
FIG. 2 is a sectional view of the apparatus in FIG. 1.

The upper iron 4 is fixed to the leading end of two right and left oscillating arms 11, 11 supported to the back side of the base 7, and the upper iron 4 is oscillated from the backward inclined position indicated by solid line in FIG. 2 to the position confronting the lower irons 2, 3, 3 as indicated by virtual line. This oscillation is executed by a first air cylinder 12 coupled to the lower end of the oscillating arms 11, 11. The two oscillating arms 11, 11 and upper iron 4 are fixed through a piston rod 14*a* of a second air cylinder 14 set up on a coupling plate 13 for coupling the oscillating arms 11, 11.

Interposing plates 16, 17 are vertically set up at both front and rear edges of a first support plate 15 fixing the leading end of the piston rod 14*a* of the second air cylinder 14, and a second support plate 18 parallel to the first support plate 15 is provided at the lower end of these interposing plates 6,17. Three third air cylinders 19, . . . are set up on the second support plate 18, and the leading ends of piston rods 19*a* . . . are fixed on the upper surface of the upper iron intermediate members 9, 10, 10.

Figure 3:
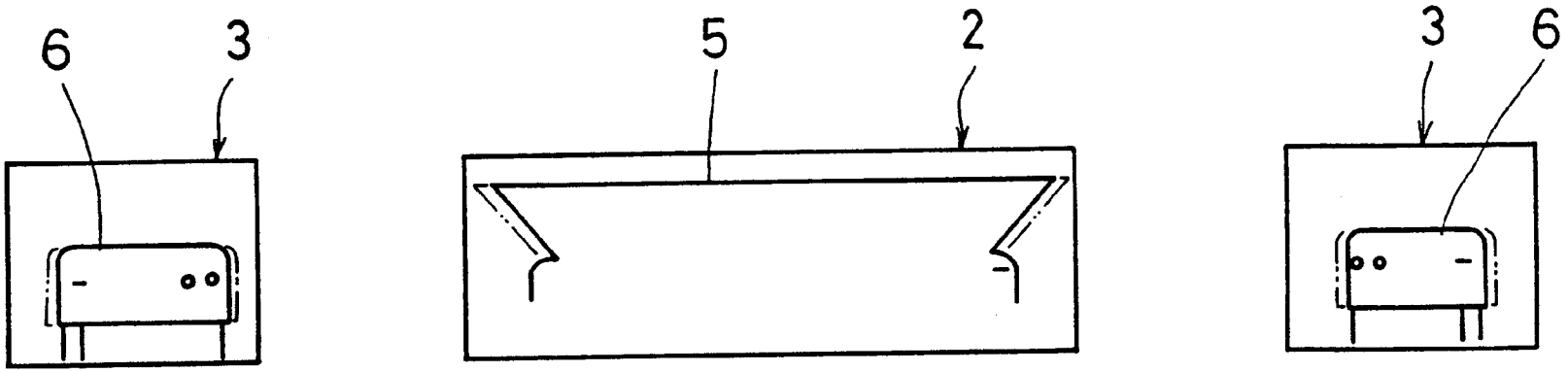
FIG. 3 is a plan view of a lower iron of the apparatus in FIG. 1 and a cloth put thereon.

Between the lower irons 2, 3, 3 and upper iron 4, a stretching mechanism 20 is provided for stretching the cloth put on the lower irons 2, 3, 3 as indicated by virtual line in FIG. 3.

Figure 4:
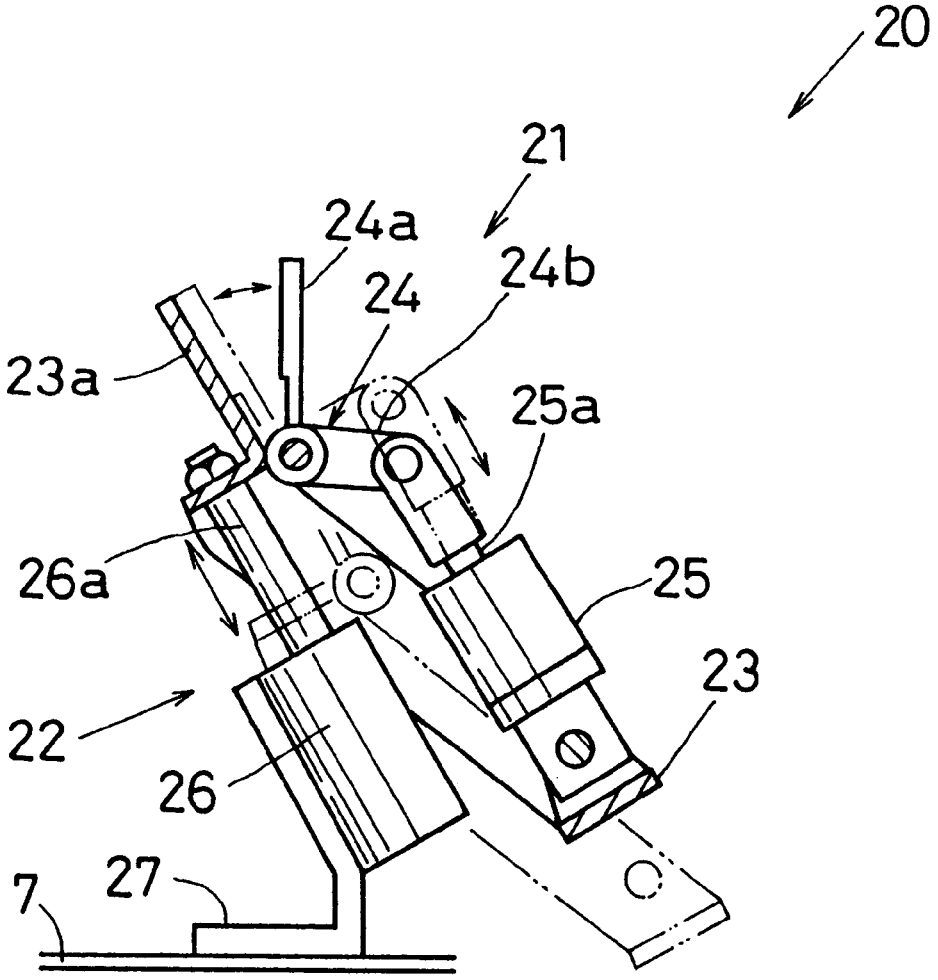
FIG. 4 is a sectional view of a stretching mechanism of the apparatus in FIG. 1.

In this embodiment, the stretching mechanism 20 is disposed at both sides of each one of the lower irons 2, 3, 3. That is, the stretching mechanism 20 comprises, as shown in FIG. 4, a gripping tool 21 for gripping the end of the cloth (collar 5, sleeves 6), and a drive mechanism 22 for moving the gripping tool 21 in the cloth stretching direction. The gripping tool 21 includes a fixing piece 23*a* extended obliquely upward from the upper end of a square-shaped support frame 23, and a holding piece 24*a* of a holding member 24 rotating so as to contact with and depart from the fixing piece 23*a*, being supported on the upper end of the support frame 23. A coupling rod 24*b* of the holding member 24 is supported to the leading end of the piston rod 25*a* of the gripping air cylinder 25 supported downward at the inner side of the support frame 23, and the holding piece 24*a* is rotated by driving the gripping air cylinder 25. That is, by projecting the piston rod 25*a*, the holding member 24 rotates and the holding piece 24*a* is pressed to the fixing piece 23*a*.

Figure 7:
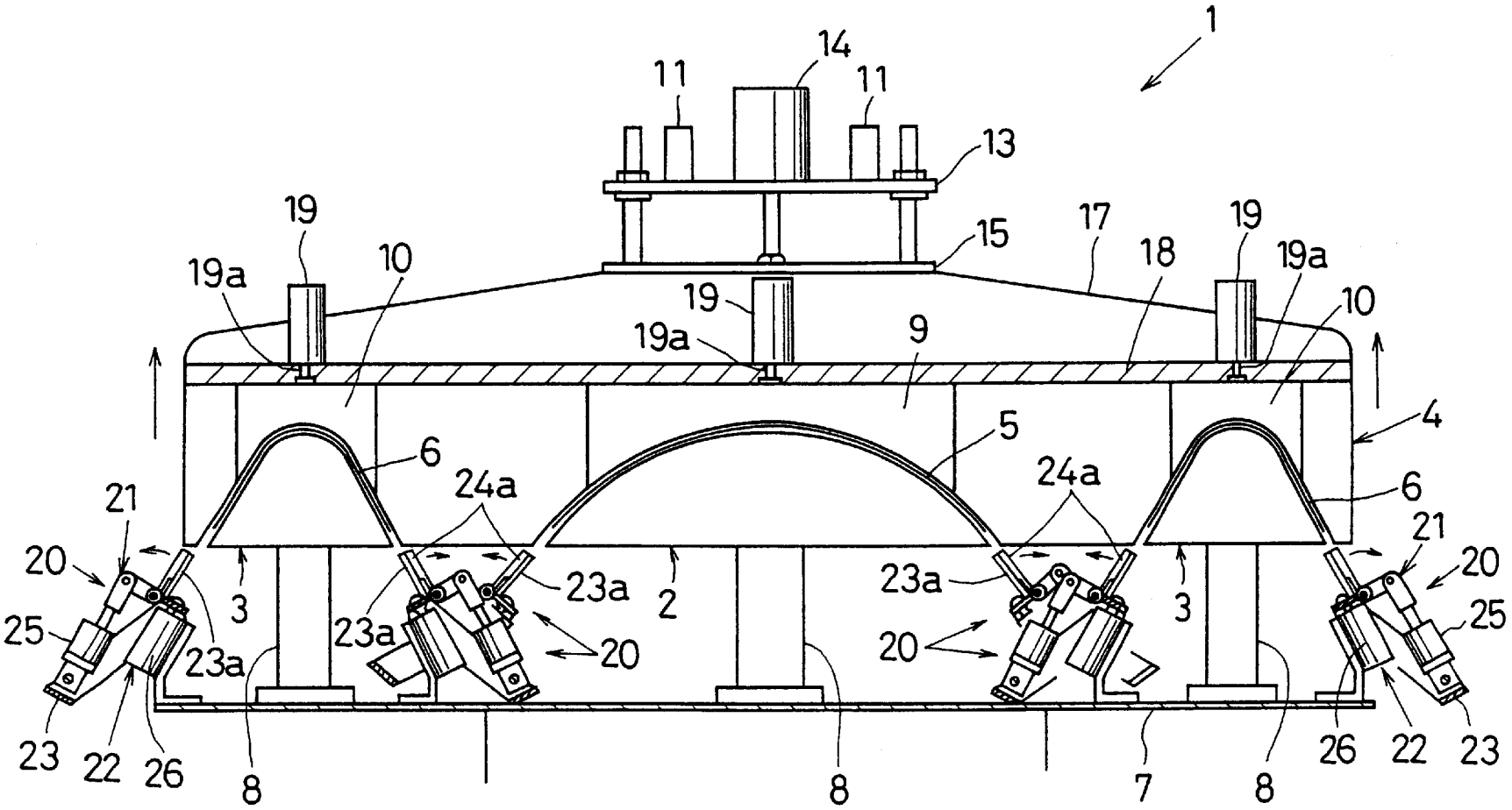
FIG. 7 is a front view of hot pressing state after stretching the cloth.

The drive mechanism 22 is composed of a pulling air cylinder 26. That is, the pulling air cylinder 26 is supported on the base 7 by a support stand 27 at a specified angle conforming to the inclination of the press faces 2*a*, 3*a* of the lower irons 2, 3, 3, and the leading end of the piston rod 26*a* of the pulling air cylinder 26 is fixed from inside to the upper end of the support frame 23 of the gripping tool 21. The pulling distance by this pulling air cylinder 26 is set so that the holding piece 24*a* and fixing piece 23*a* may retreat so as not to contact with the upper iron 4 when hot pressing by lowering the upper iron 4 as shown in FIG. 7. If sufficient interval is not assured between the lower iron 2 for the collar and the lower irons 3, 3 for the sleeves, the stretching mechanism 20 may be disposed by shifting the position in the longitudinal direction.

In thus constituted apparatus 1, the collar 5 and sleeves 6 of a shirt are shaped and finished in the following operation.

Figure 5:
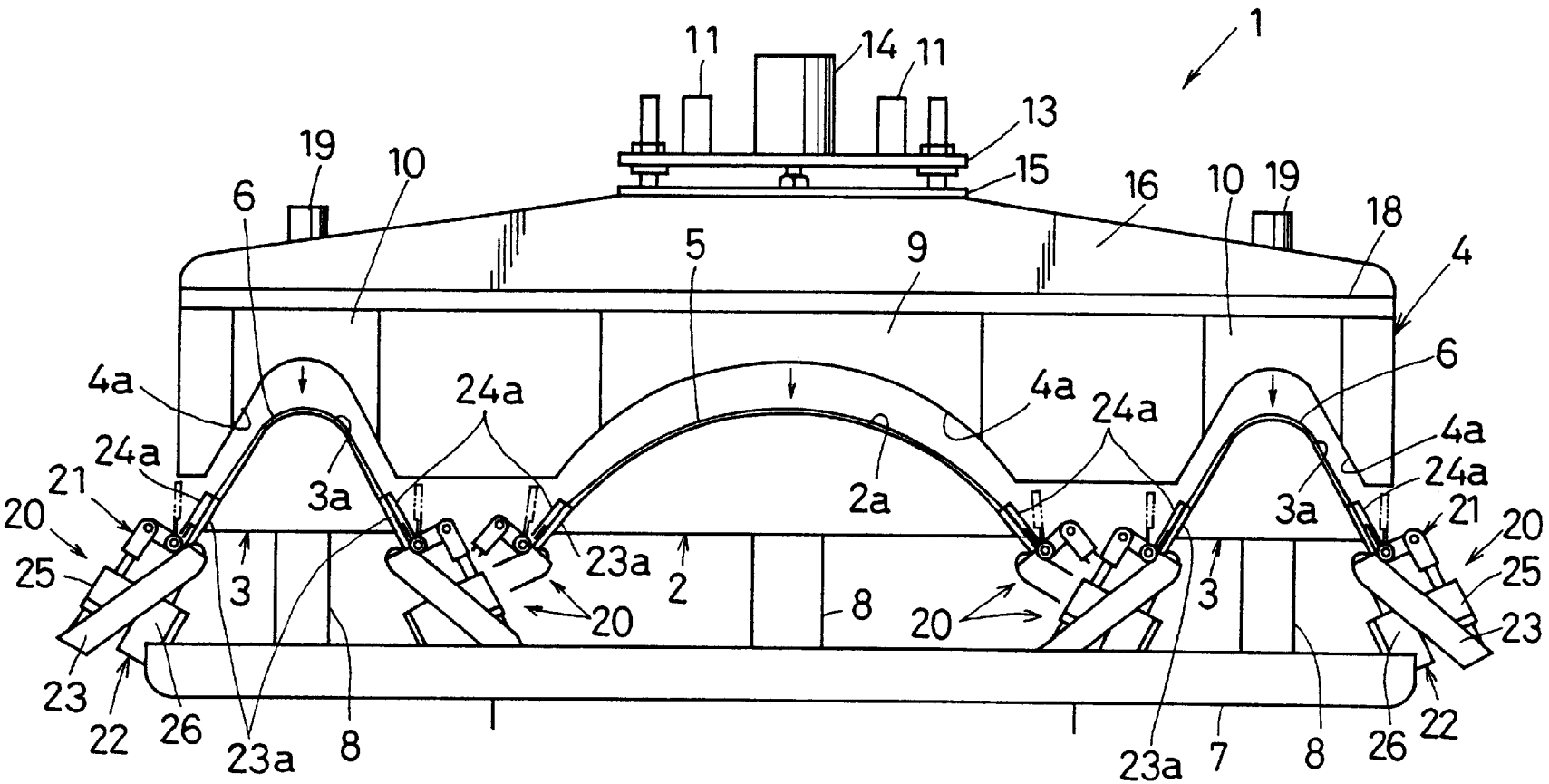
FIG. 5 is a front view of the state of the cloth held by a gripping tool of the stretching mechanism.
Figure 6:
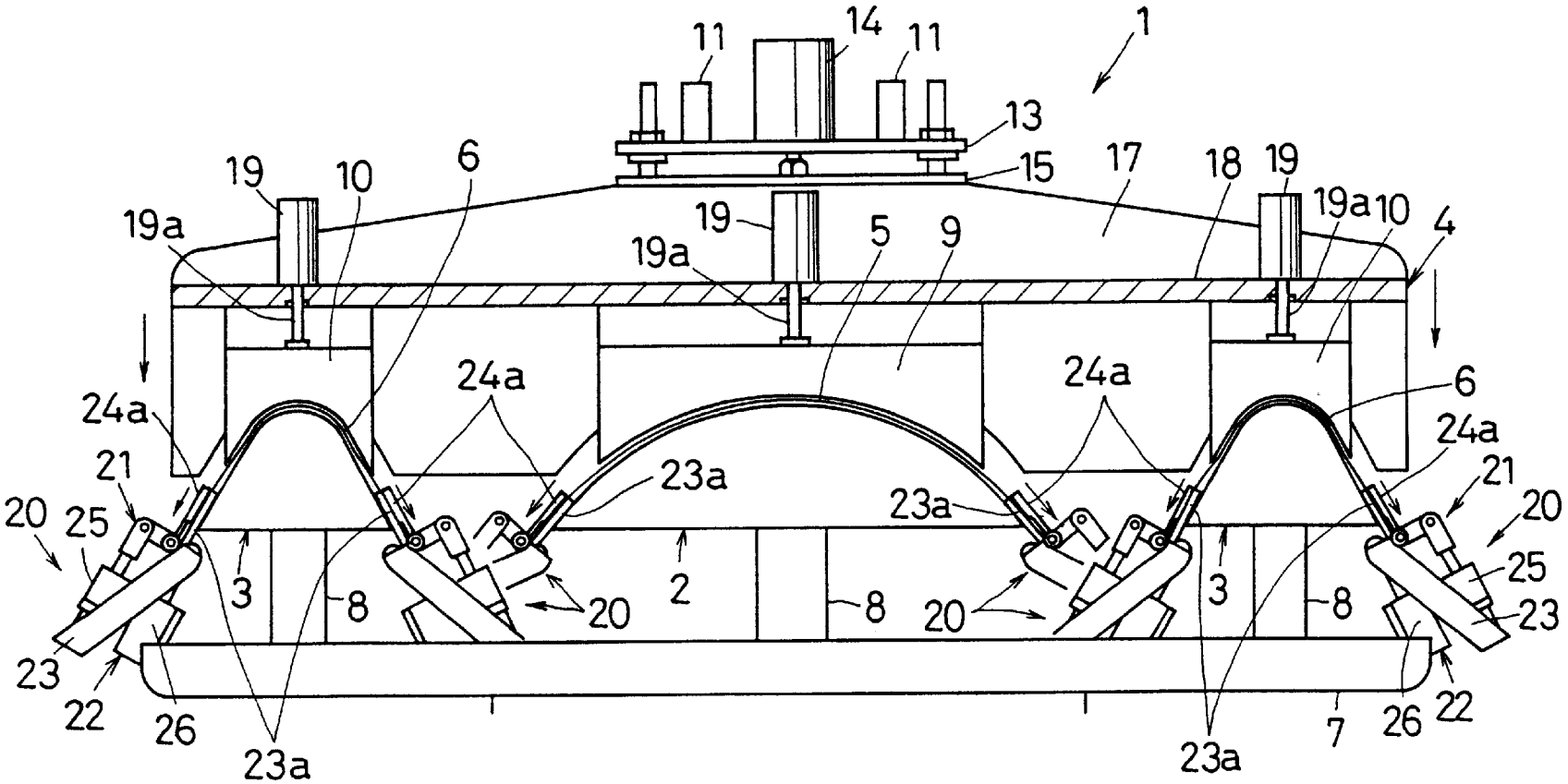
FIG. 6 is a front view of cloth heating state.

First, as shown in FIG. 3, the collar 5 and sleeves 6 are spread and put on the lower irons 2, 3, 3, and the gripping air cylinder 25 is driven to project the piston rod 25*a*, and the holding piece 24*a* of the holding member 24 is pressed from above to the both ends of the cloth and is gripped by the fixing piece 23*a*. In succession, driving the first air cylinder 8, the upper iron 4 is set opposite to the lower irons 2, 3, 3 (see FIG. 5). Driving the third air cylinders 19, . . . , the upper iron intermediate members 9, 10, 10 heated to a proper temperature are lowered to press the cloth lightly (see FIG. 6). After a specified time allowed for loosening the adhesive padding cloth of the cloth, the pulling air cylinder 26 of the stretching mechanism 20 is driven, and the piston rod 26*a* is drawn back, and the gripping tool 21 is pulled obliquely downward. By this pulling action, the cloth is stretched on the lower irons 2, 3, 3 (see virtual line in FIG. 3), and at the stretching limit, the holding piece 24*a* and fixing piece 23*a* depart from the cloth, and are positioned at specified position lower than the lower end position of the lower irons 2, 3, 3. Then, driving the second air cylinder 14, the piston rod 14*a* is projected and the upper iron 4 is lowered, and the third air cylinders 19, . . . are driven to put back the piston rod 19*a*, and the cloth on the lower irons 2, 3, 3 is hot pressed strongly by the press faces 4*a*, . . . , now becoming flat (see FIG. 7). After pressing for a specified time, the apparatus returns to the initial state.

Thus, sine the cloth is stretched before the finish pressing stage, the cloth shrinking by washing can be restored to the original size, and pressed and finished in this state. Therefore, even in machine finishing where a high working efficiency is demanded, the cloth can be pressed in a stretched state, and is finished in a brand-new state being free from shrinkage or crease. In other words, the collar and sleeves, the important parts of a shirt, can be freshly regenerated.

Moreover, since the stretching process for returning the cloth to the original size is done mechanically by the stretching mechanism 20, the operation is simple, and stretching is uniform, and a homogeneous finished state is obtained. Still more, when the stretching mechanism 20 is constituted as in this case, the structure of the apparatus is relatively simplified, and the cost is reduced.

The fixing piece 23*a* may not be formed in the gripping tool 21, and the cloth can be gripped by the holding piece 24*a* and the press faces 2*a*, 3*a* of the lower irons 2, 3, 3, and the cloth may be stretched only by move of the holding piece 24*a*.

Figure 8:
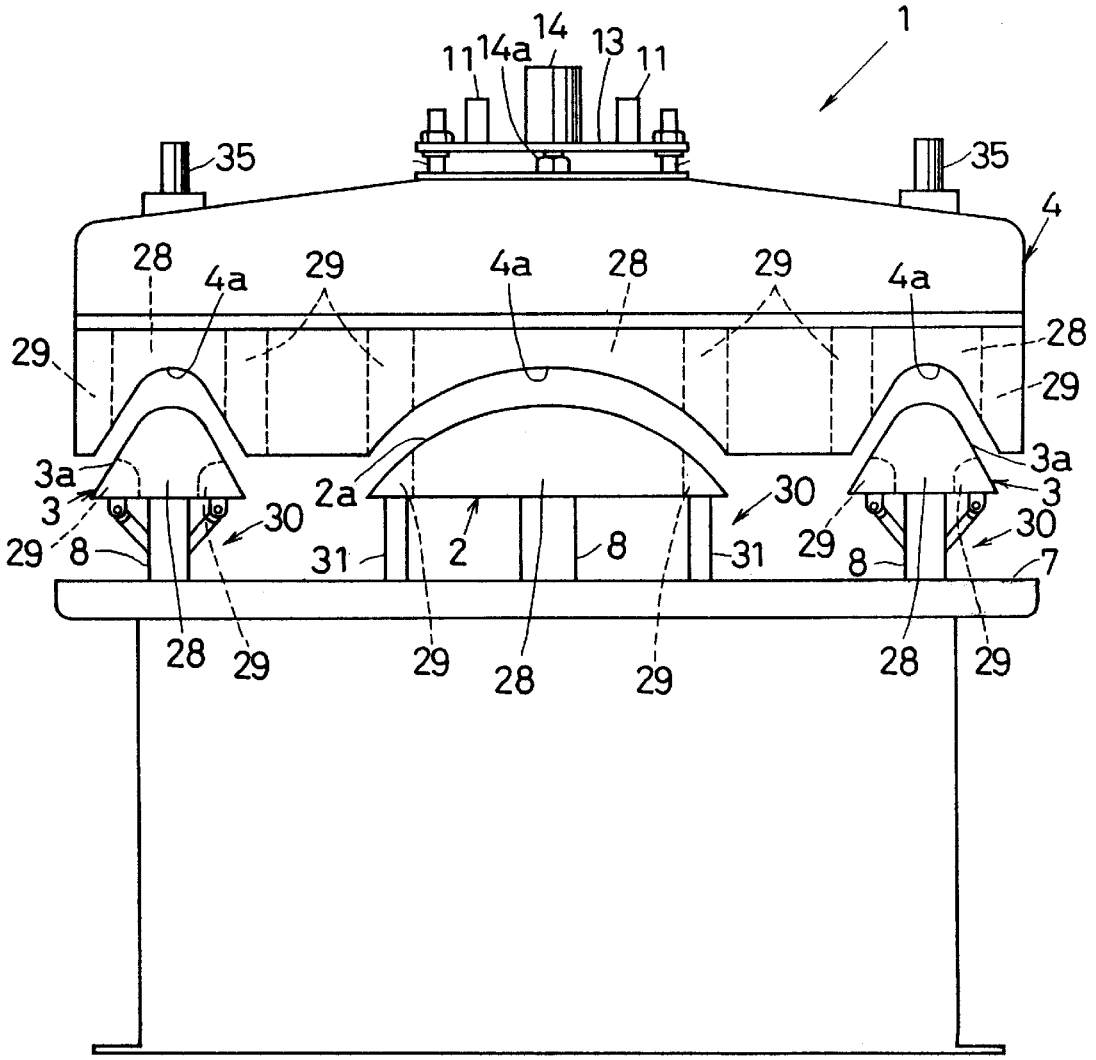
FIG. 8 is a front view of a collar and sleeve shaping apparatus in other embodiment.

FIG. 8 is a front view of an apparatus 1 in other example, and in this apparatus 1, the stretching mechanism 20 is formed in the lower irons 2, 3, 3 and upper iron 4. That is, it is disposed at both sides of the lower irons 2, 3, 3 and the upper iron 4, and is composed of movable members 29, 29 contacting with and departing from the main body member 28 at the intermediate position of each iron, and a drive mechanism 30 for moving these movable members 29, 29 so as to contact with and depart from the main body member 28.

The lower irons 2, 3, 3 are divided in three sections in the lateral direction, and is composed of the main body member 28 at the intermediate position, and the movable members 29, 29 at both sides.

In the lower iron 2 for the collar, the main body member 28 is fixed on the support column 8, the movable members 29, 29 are supported by a second support column 31 set up from the lower side of the base 7, and it is designed to contact with or depart from the main body member 28 in the horizontal direction by the lateral move of the second support column 31. The drive mechanism 30 for driving the second support column 31 laterally may be realized by a mechanism as shown in, for example, FIG. 9. From the lower end of the right and left second support columns 31, a horizontal extension 32 is formed toward the support column 8 side, and the extensions 32 are designed to overlap vertically at a specific interval. At the confronting side of the overlapping portion, a rack 32*a* is formed, and a pinion 33 is placed between the racks 32*a*. Atone extension 32, a piston rod 34*a* of a first air cylinder 34 for pulling laid down horizontally is coupled. By driving the first air cylinder 34 for pulling, the right and left movable members 29, 29 simultaneously contact with and depart from the man body member 28.

Figure 10:
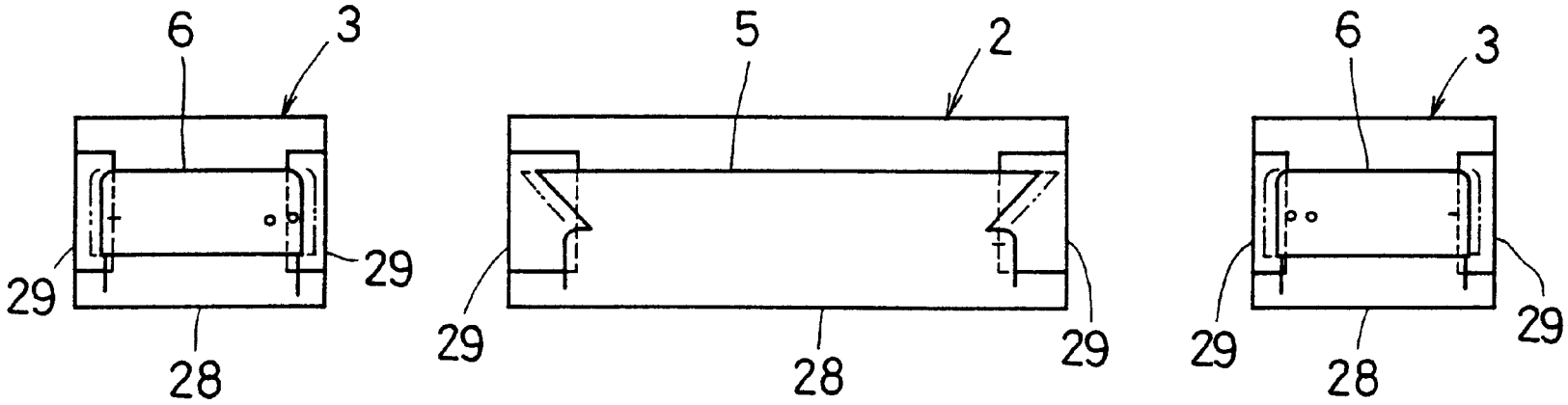
FIG. 10 is a plan view of a lower iron of the apparatus in FIG. 8 and a cloth put thereon.

As shown in FIG. 10, the movable members 29, 29 are formed at a narrower width in the longitudinal direction than the main body member 28, and a guide structure (not shown) is formed between the main body member 28 and the front and rear ends of the movable members 29, 29 so that the movable members 29, 29 may move only in the horizontal direction.

Figure 9:
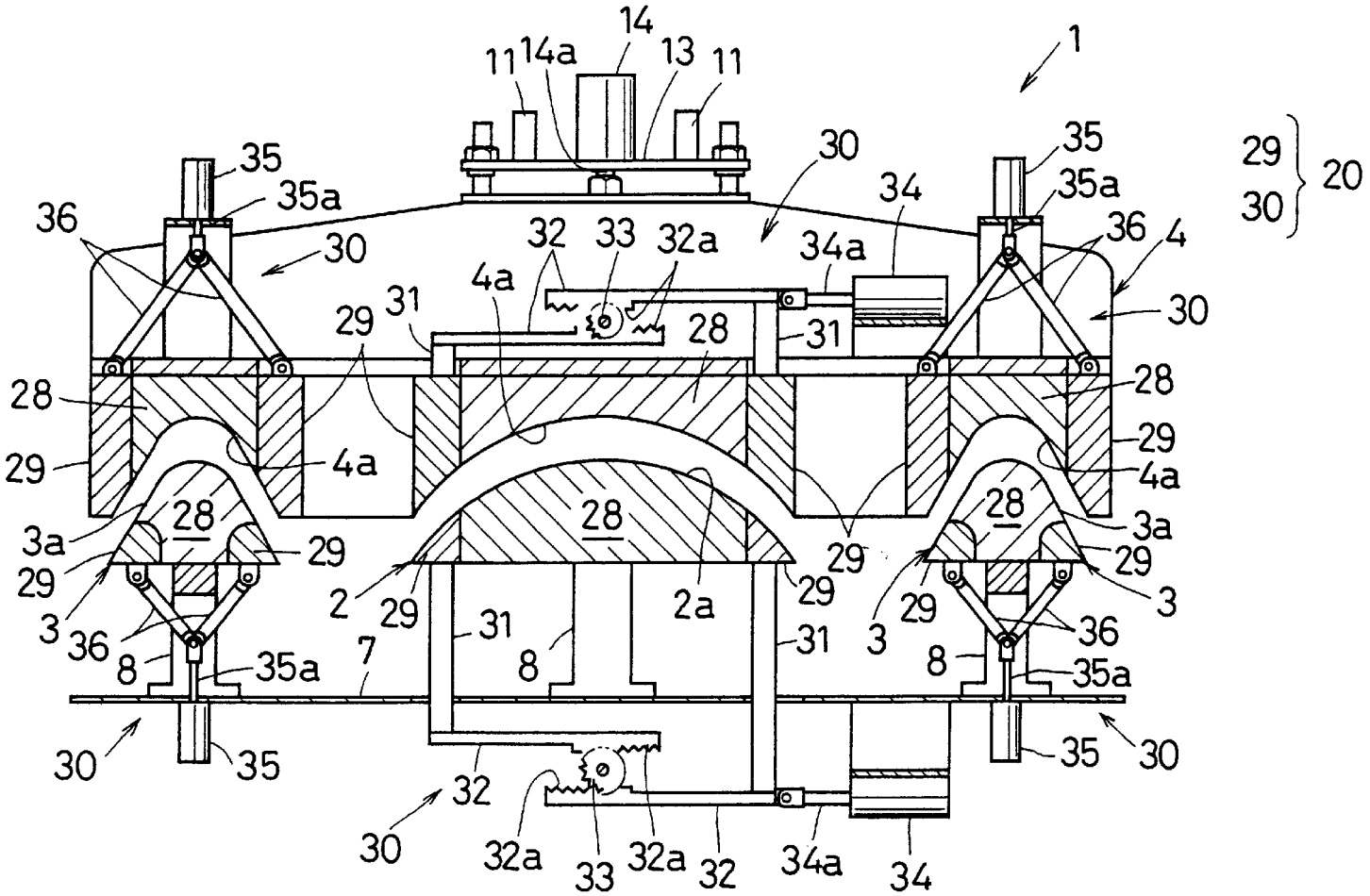
FIG. 9 is a sectional view showing an essential structure of the apparatus in FIG. 8.

The lower irons 3, 3 for the sleeves are designed to move reciprocally obliquely downward along the slope of the press faces 3*a* on the movable members 29, 29 owing to their specific shape. Accordingly, the structure of the drive mechanism 30 may be as shown in FIG. 9. The main body member 28 is supported by the support column 8. The movable members 29, 29 are formed at a narrower width in the longitudinal direction than the main body member 28, and supported by the main body member 28 through a guide structure (not shown) so as to slide only downward obliquely. The lower faces of these movable members 29, 29 supported by two coupling rods 36, 36 formed in a bifurcate form on one piston rod 35*a* of a second air cylinder 35 for puling fixed at the lower side of the support column 8 in the base 7.

The upper iron 4, same as the lower irons 2, 3, 3, is formed by dividing the press faces 4*a*, . . . in three sections in the lateral direction, and the movable members 29, 29 at right and left sides are formed to contact with and depart from the main body member 28 at the intermediate position. In the case of the middle press face 4*a* for the collar, the movable members 29, 29 are designed to move in the horizontal direction, and in the case of the press faces 4*a* for the sleeves at both sides, the movable members 29, 29 are designed to move obliquely downward along the slope of the press faces 4*a*, by the same configuration of the lower irons 2, 3, 3 as mentioned above. The specific structure is same, and the same reference numerals are given and the description is omitted.

In thus constituted apparatus 1, the collar 5 and sleeves 6 of a shirt are shaped and finished in the following procedure.

Figure 11:
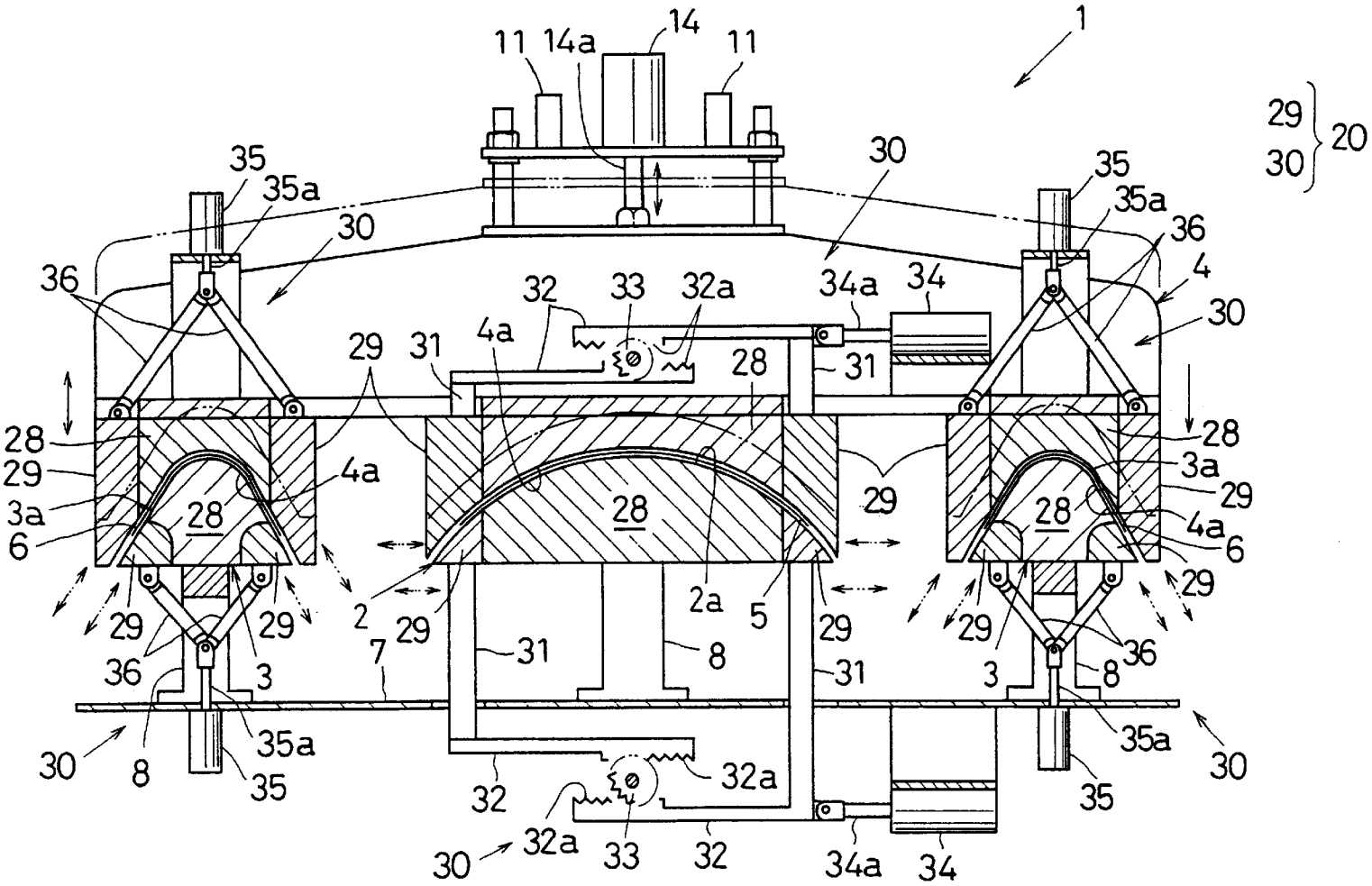
FIG. 11 is a sectional view of cloth heating state.
Figure 12:
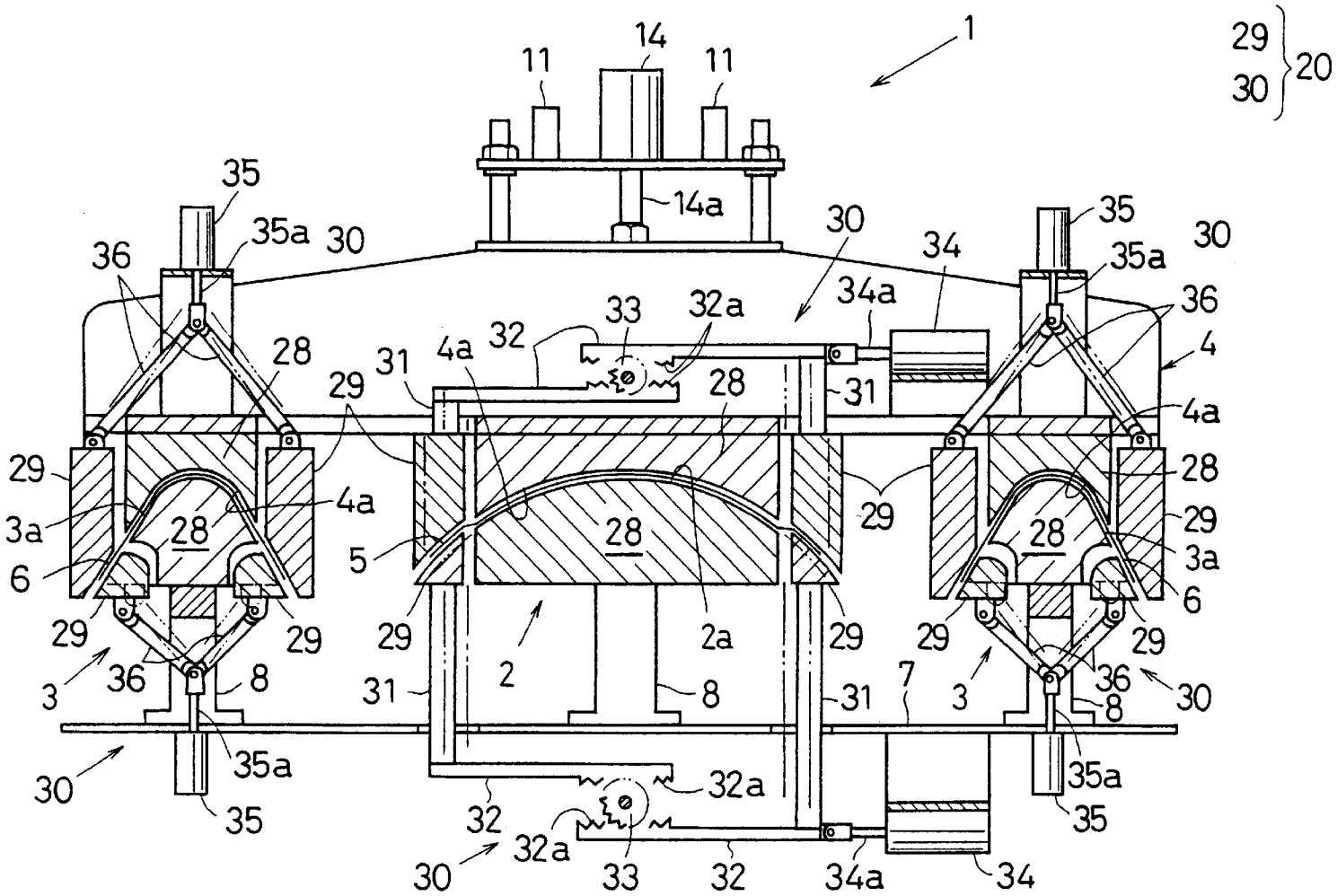
FIG. 12 is a sectional view of cloth stretching state.

First, as shown in FIG. 10, the cloth (collar 5 and sleeves 6) is spread and put on the lower irons 2, 3, 3. Driving the second air cylinder 14, the piston rod 14*a* is extended, and the upper iron 4 is pressed against the cloth (see FIG. 11). By the heat of the upper iron 4, the adhesive padding cloth of the cloth is loosened, and each drive mechanism 30 is driven so as to straighten shrinkage of the cloth, and the movable members 29, 29 are moved in the direction of departing from the main body member 28. At this time, the upper and lower confronting movable members 29 grip the end of the cloth, and pull laterally and obliquely downward, so that the cloth is stretched (see FIG. 12). Once the cloth is stretched, the upper iron 4 is raised, and each drive mechanism 30 is restored to the initial state. Shaping the cloth as required, the upper iron 4 is lowered again, and pressed strongly to finish.

In this way, by the stretching mechanism of the cloth by the iron itself, it is not necessary to have other members, such as clips for gripping the both right and left ends of the cloth, and there is no obstacle on the base 7. Without troubles such as catching of the shirt during work, the ease of work is assured.

What is claimed is:

1. A collar and cuff shaping apparatus comprising:

a pair of lower end irons;

a lower center iron disposed between said pair of lower end irons;

an upper iron disposed to be correspondingly above said pair of lower end irons and said lower center iron;

said upper iron incorporating therein a heating device;

wherein a collar is disposed on said lower center iron for pressing, and a pair of cuffs are disposed on said pair of lower end irons for pressing;

a stretching means for said collar and said pair of cuffs which comprises:

a stretching mechanism for gripping both the ends of said collar or cuffs before shaping and pulling said collar and cuff in a stretching direction, installed on each iron or beside each iron.

2. The apparatus of claim 1, wherein said stretching means comprises:

gripping tools disposed at both sides of said lower center iron and said pair of lower end irons; and a drive mechanism for moving said gripping tools in said stretching direction.

3. The apparatus of claim 1, wherein said stretching means comprises:

movable members disposed at both sides of each iron for contacting with and departing from a main body in an intermediate position of each iron; and a drive mechanism for moving said movable members to contacting with and departing from a main body member.

4. The apparatus of claim 1, wherein comprising:

a control means for causing said upper iron to move toward said pair of lower end irons and said lower center iron, then for causing heated said upper iron to press lightly said collar and said pair of cuffs disposed on said lower center iron and said pair of lower end irons, and then after specified time to allow for loosening of adhesive padding of said collar and said pair of cuffs, causing said stretching means to stretch said collar and said pair of cuffs on said lower center iron and said pair of lower end irons, respectively, and then at a stretching limit of said collar and said pair of cuffs releasing said collar and pair of cuffs, and then causing heated said upper iron to press strongly onto said collar and said pair of cuffs disposed on said lower center iron and said pair of lower end irons, respectively, whereby said collar and cuffs are stretched prior to completion of pressing so that creasing and shrinkage are reduced.

5. The apparatus of claim 2, wherein said upper iron is composed of a plurality of upper irons disposed to be correspondingly above said pair of lower end irons and said lower center iron;

wherein said drive mechanism comprises means for concurrently moving said upper irons so as to concurrently press said collar and pair of cuffs.

6. The apparatus of claim 2, wherein said upper iron is composed of a plurality of upper irons disposed to be correspondingly above said pair of lower end irons and said lower center iron;

wherein said drive mechanism comprises means for separately moving said upper irons so as to separately press said collar and said pair of cuffs.

* * * * *